US006685186B2

(12) United States Patent
Wilson

(10) Patent No.: US 6,685,186 B2
(45) Date of Patent: Feb. 3, 2004

(54) MULTI-LAYER PUZZLES

(76) Inventor: Linda Wilson, 1927 San Acacio, Las Cruces, NM (US) 88001

( * ) Notice: Subject to any disclaimer, the term of this patent is extended or adjusted under 35 U.S.C. 154(b) by 0 days.

(21) Appl. No.: 09/912,805

(22) Filed: Jul. 24, 2001

(65) Prior Publication Data

US 2002/0008355 A1 Jan. 24, 2002

Related U.S. Application Data

(60) Provisional application No. 60/220,299, filed on Jul. 24, 2000.

(51) Int. Cl.[7] ..... A63F 9/10
(52) U.S. Cl. ..... 273/157 R
(58) Field of Search ..... 273/157 R, 157 A, 273/156

(56) References Cited

U.S. PATENT DOCUMENTS

| | | | | | |
|---|---|---|---|---|---|
| 2,848,823 | A | * | 8/1958 | Washburn | 273/157 R |
| 3,647,218 | A | * | 3/1972 | Foley | 273/157 R |
| 3,682,479 | A | | 8/1972 | Miller et al. | 273/157 R |
| 4,385,467 | A | * | 5/1983 | Samuels | 273/157 R |
| 4,719,656 | A | * | 1/1988 | Godinet | 273/157 R |
| 4,815,742 | A | | 3/1989 | Augustine | 273/157 A |
| 5,213,507 | A | * | 5/1993 | Ozrovitz | 273/157 R |
| 5,232,088 | A | * | 8/1993 | Leondidis | 273/157 R |
| 5,299,805 | A | | 4/1994 | Green | 273/157 A |
| 5,362,054 | A | * | 11/1994 | Ashemimry | 273/157 R |
| 5,615,883 | A | * | 4/1997 | Stevens | 273/157 R |
| 5,769,418 | A | * | 6/1998 | Gilbert et al. | 273/157 A |
| 6,098,980 | A | * | 8/2000 | Ramage et al. | 273/157 R |

* cited by examiner

*Primary Examiner*—Steven Wong

(57) ABSTRACT

A multi-layer puzzle having a base with a perimeter portion and a cavity that depicts a theme. Jigsaw puzzle layers are disposed within the cavity and have scenes related to the theme. The multi-layer puzzle may have one or more independent pieces which are cut out as a complete piece painted on both sides to be used as an independent play figure for the user to act out the story or theme. The multi-layer puzzle may have one or more blank unpainted complete layers for the user to add their own scene with paints or markers. The multi-layer puzzle may have one or more blank unpainted jigsaw pieces cut in the complete form for the user to create his/her own independent play figure using paints or markers. The puzzle may be in "book" form with multi-layer puzzles used in multiples to tell a story.

10 Claims, 16 Drawing Sheets

PUZZLE 18

PUZZLE 10

PUZZLE 10

PUZZLE 10
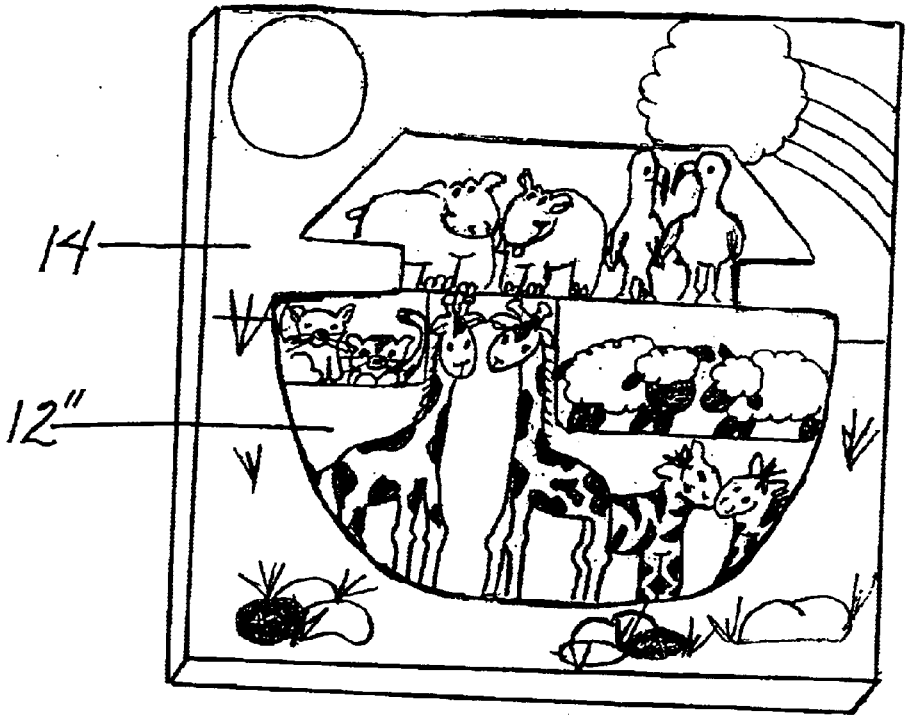
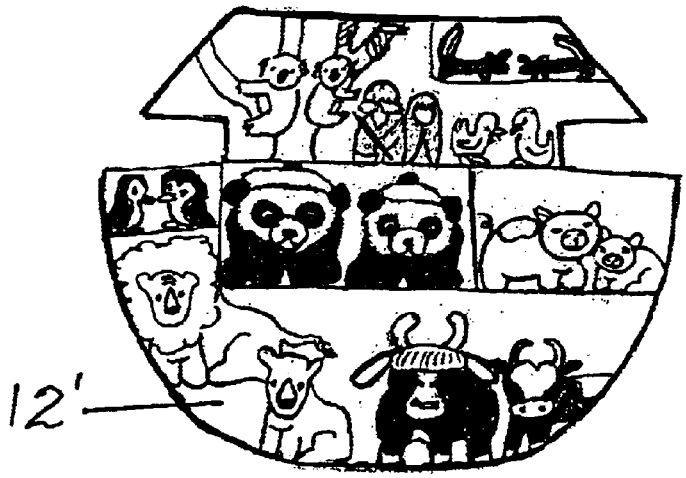
FIG. 4

PUZZLE 10
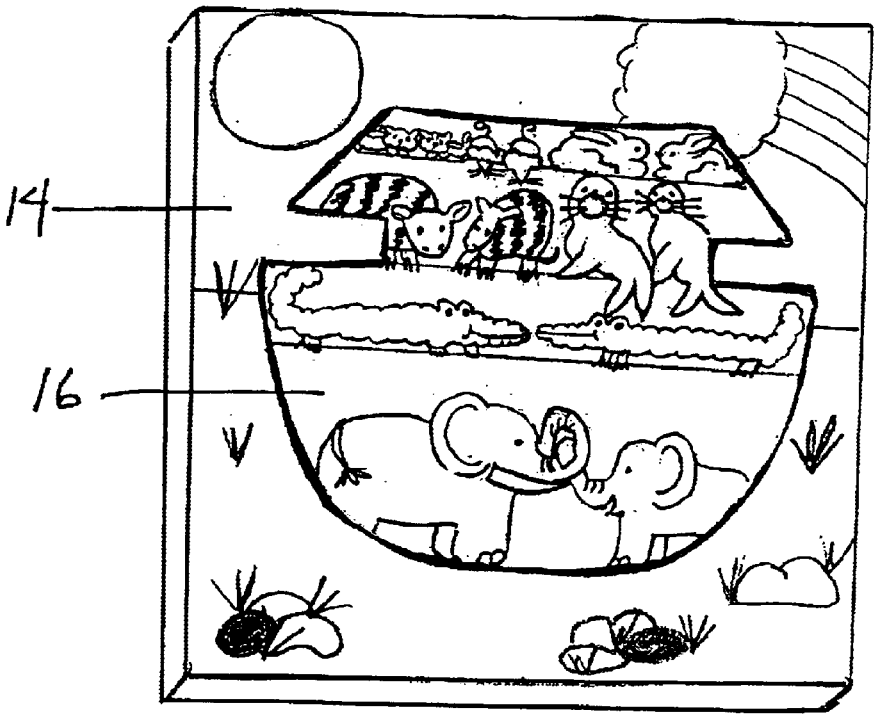
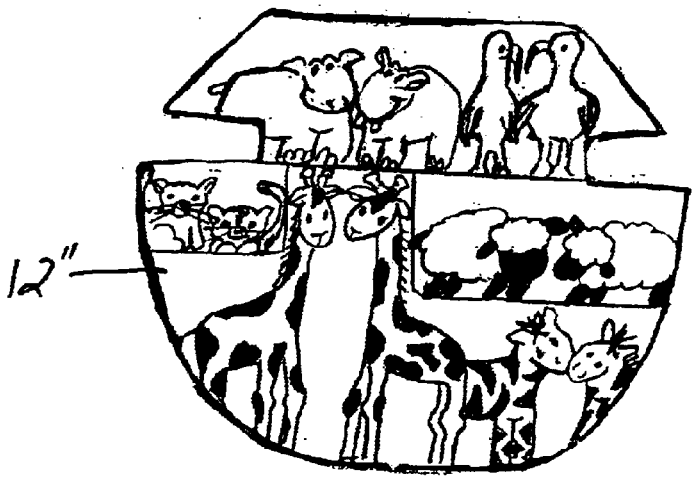
Fig. 5

PUZZLE 18

PUZZLE 18

PUZZLE 18
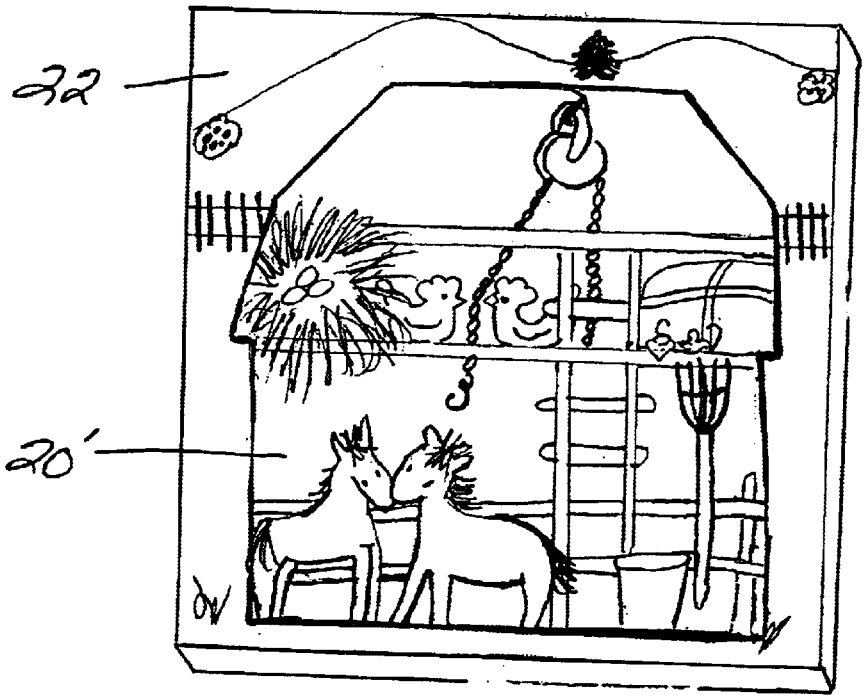
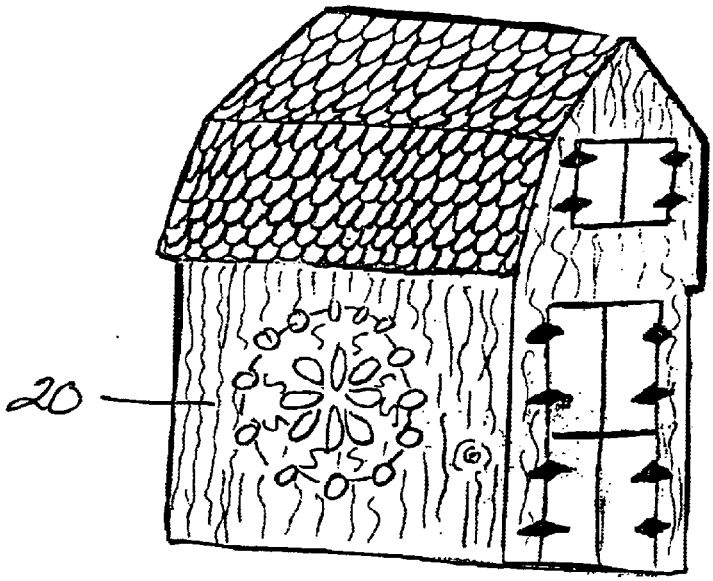
Fig. 8

PUZZLE 18
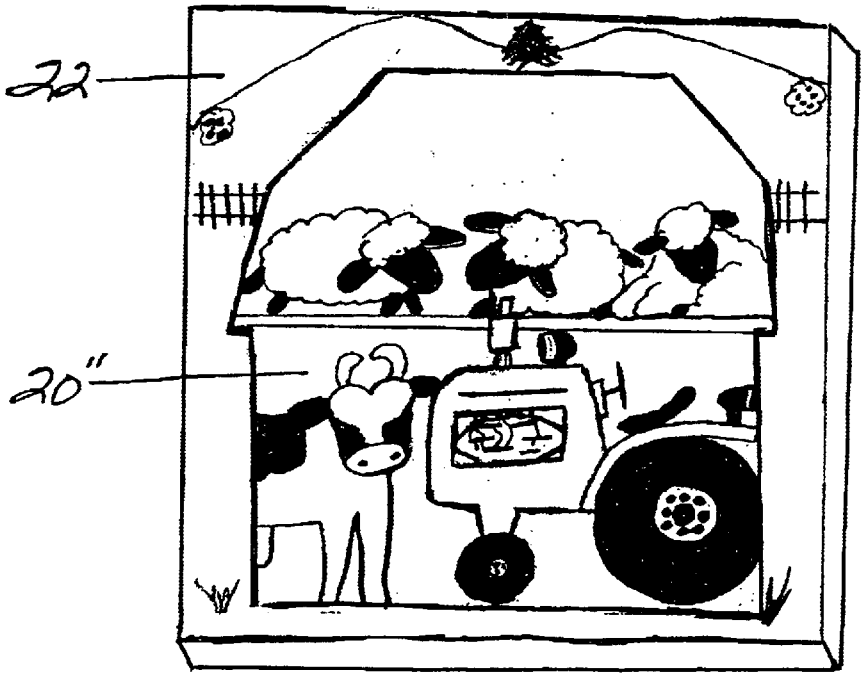
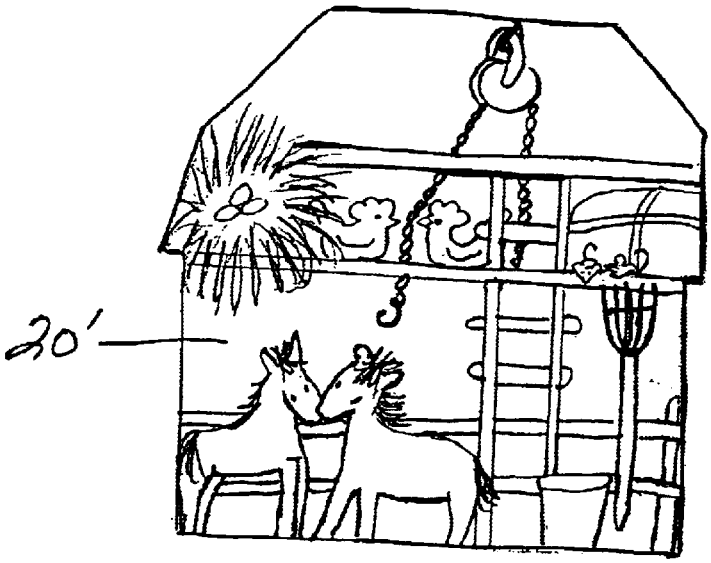
Fig. 9

PUZZLE 18
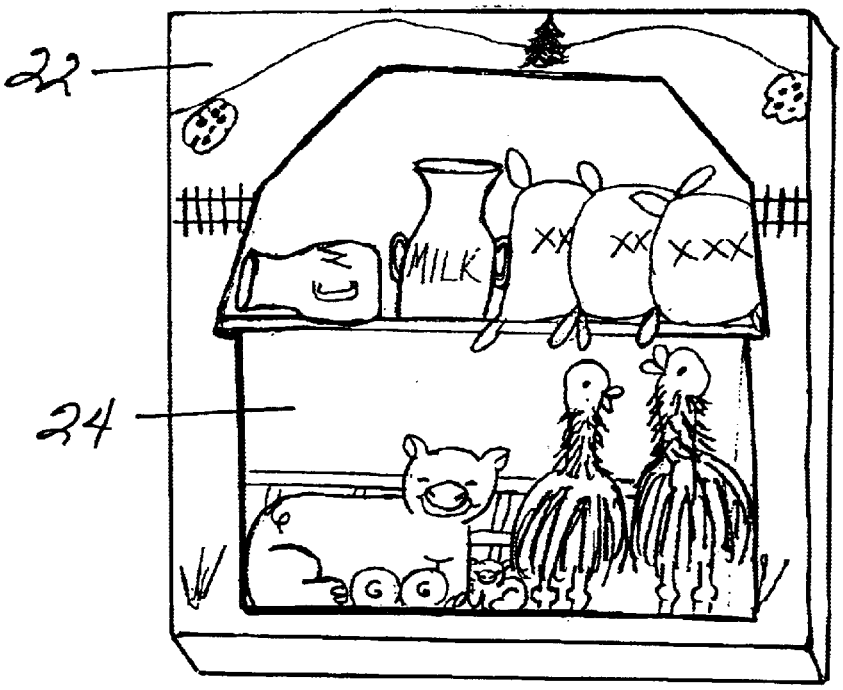
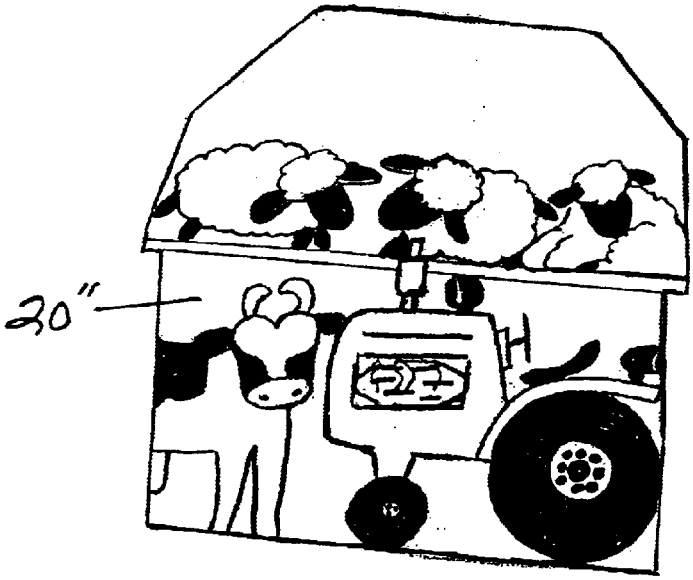
Fig. 10

PUZZLE 18

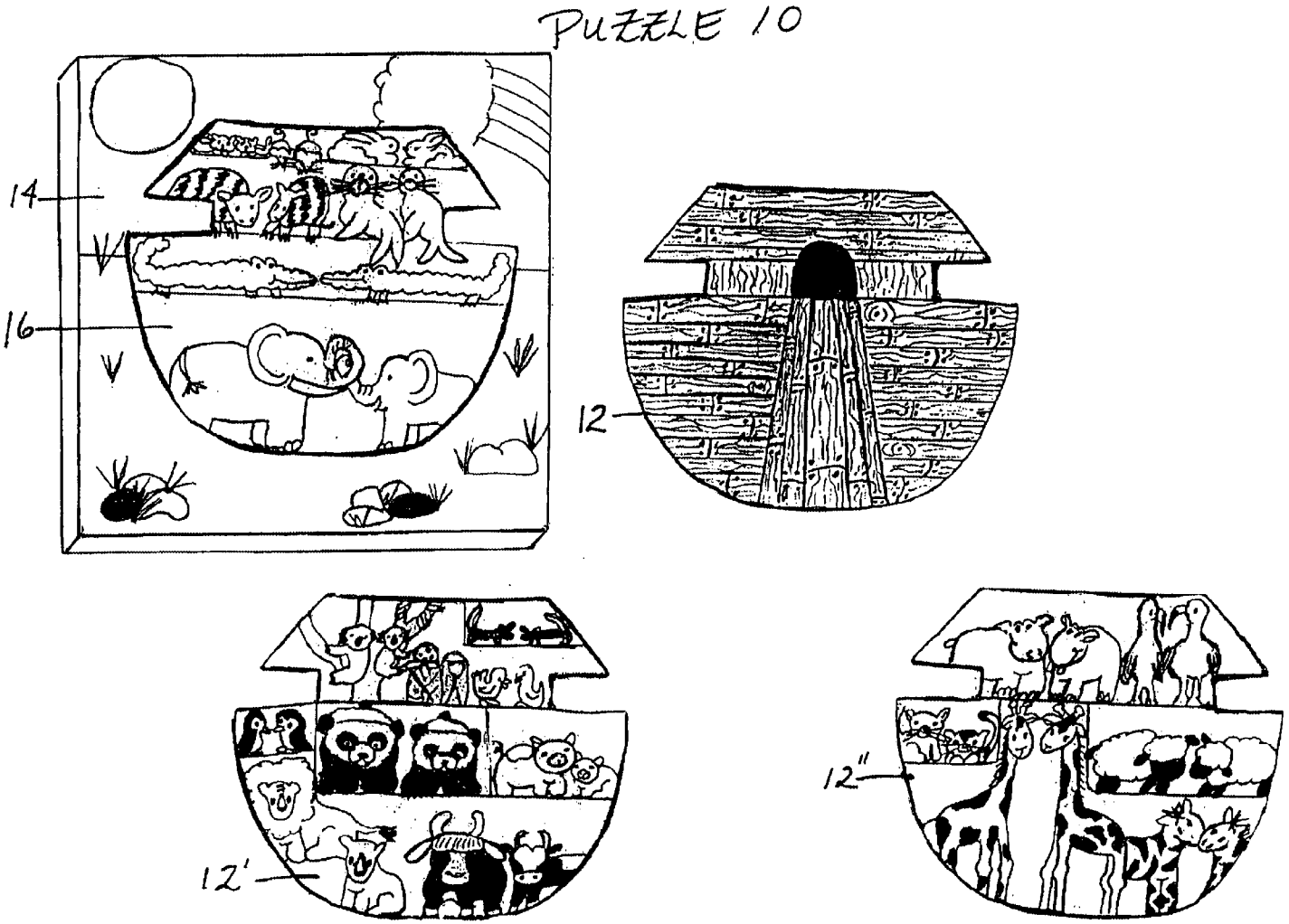
Fig. 12 (page 1)

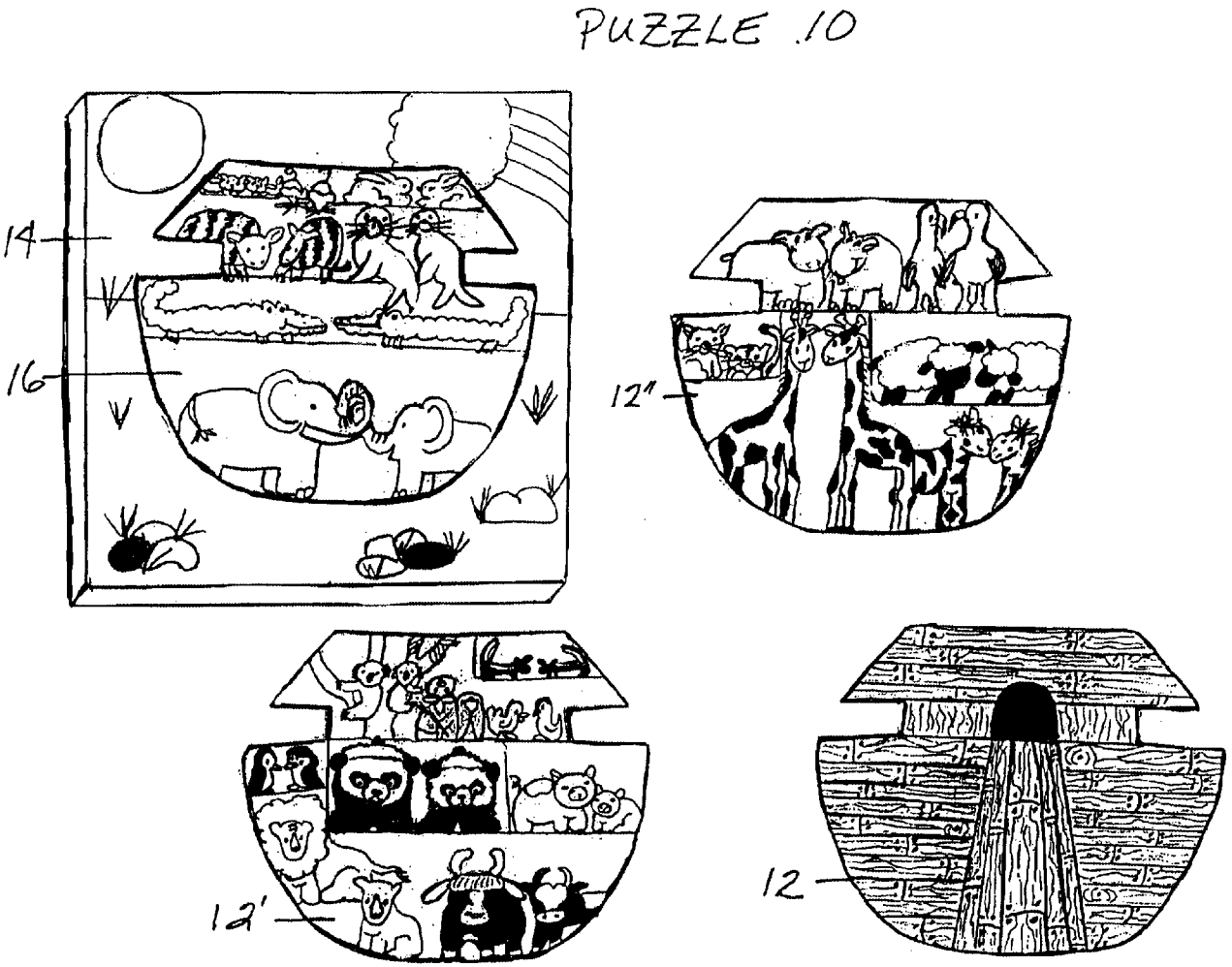
Fig. 12 (page 2)

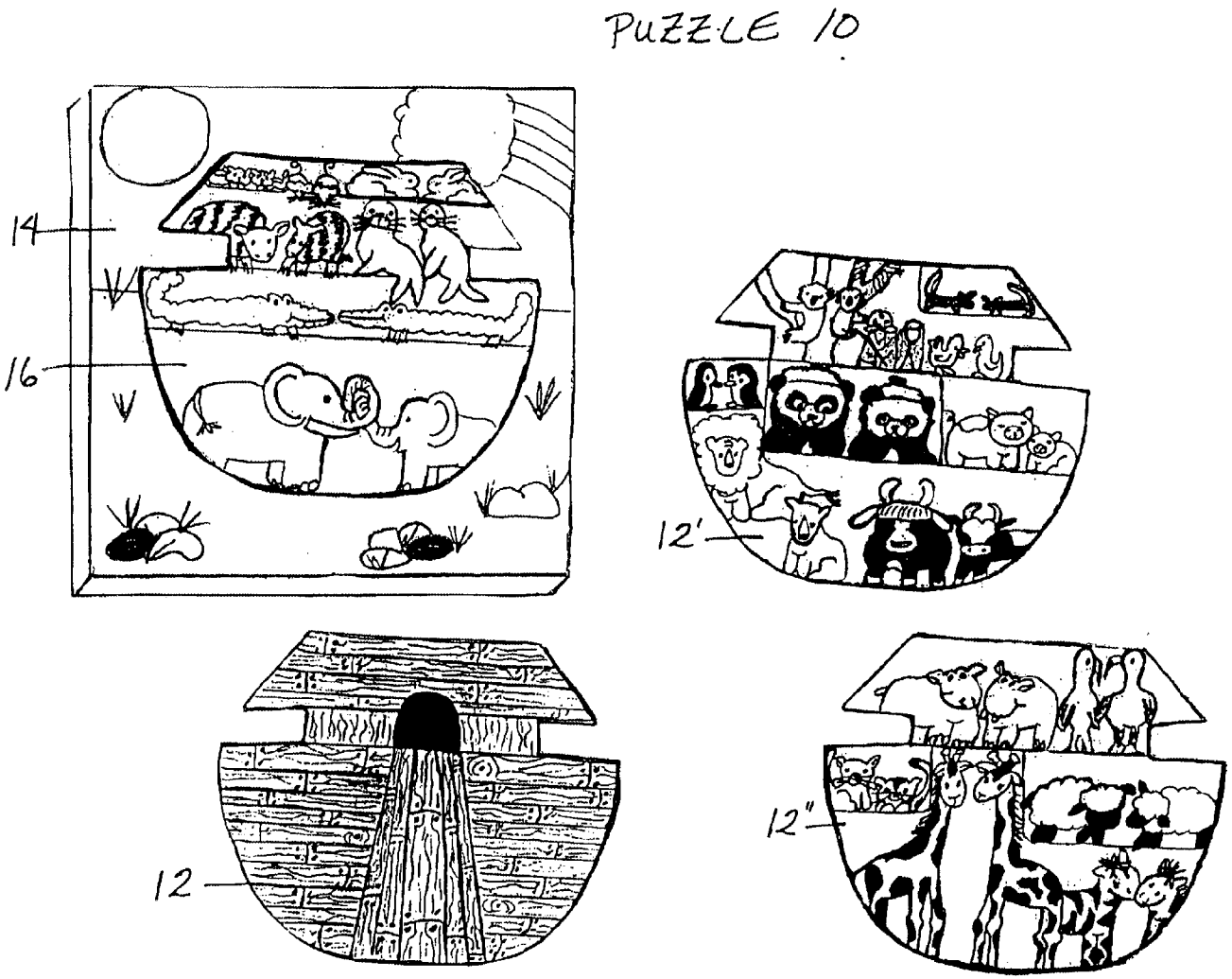
Fig. 12 (page 3)

MULTI-LAYER PUZZLES

CROSS-REFERENCE TO RELATED APPLICATIONS

This application claims the benefit of the filing of U.S. Provisional Patent Application Serial No. 60/220,299, entitled "Multi-Layer Puzzles" filed on Jul. 24, 2000, and the specifications thereof is incorporated herein by reference.

COPYRIGHTED MATERIAL

A portion of the disclosure of this patent document contains material that is subject to copyright protection. The owner has no objection to the facsimile reproduction by anyone of the patent document or the patent disclosure, as it appears in the Patent and Trademark Office patent file or records, but otherwise reserves all copyrights whatsoever.

BACKGROUND

1. Field of Invention

The present invention relates to a multi-layer puzzle.

2. Background Art

Three-dimensional or multi-layer puzzles exist in the prior art. Puzzles often provide a dual function to entertain and educate. By including educational themes, puzzles Serve as an educational tool. Multi-layer puzzles may enhance the educational and continual entertainment for the users.

U.S. Pat. No. 3,682,479, entitled "Three Dimensional Puzzle", to Miller et al. This puzzle has interlocking puzzle segments with voids through each layer.

U.S. Pat. No. 4,815,742, entitled "Multi-Layered Puzzle", to Augustine, is directed to a multi-layered puzzle with transparent layers.

U.S. Pat. No. 5,299,805, entitled "Multilayer Puzzle," to Green, is directed to a multi-layer puzzle with polygons of identical shape and transparent materials.

U.S. Pat. No. 5,362,054, entitled "Multi-layered Educational and Entertaining Device Including a Plurality of Independent Layers," to Ashemimry, is directed to a multi-layer puzzle with independent layers in a frame.

U.S. Pat. No. 5,615,883, entitled "Figurine Puzzle with Display Apparatus," to Stevens, is directed to a single layer puzzle with a display with a hinge.

U.S. Pat. No. 5,232,088, entitled "Greeting Card Puzzle Kit," to Leondidis, is directed to a single layer puzzle designed for sending greetings or invitations.

U.S. Pat. No. 3,647,218, entitled "Pan Puzzles" to Foley, is directed to puzzles cut in piece of pie shape in a container in the shape of a pie pan.

U.S. Pat. No. 5,213,507, entitled "Instructional Child's Story and Picture Book," to Orzovitz, is directed to a picture book with at least one of the pages having text on one side and a puzzle on the other side.

Previous attempts to provide educational and entertaining multi-layer puzzles are referred to above. However, while each of the devices described in these references include a plurality or multiple of layers which depend on other layers to be educational and entertaining only Ashemimry's follows a theme.

The disadvantage of most of the multi-layer puzzles is that lack of interest develops once the puzzles are initially solved.

Thus there is a need in the art for a multi-layer puzzle to entertain and educate the user while providing a means by which to maintain the user's interest.

There is an additional need for the multi-layer to include in the layers a common theme wherein the user has the opportunity to participate using individual puzzle pieces as stand alone toys to act out the theme.

Also, the present invention provides for a base with a perimeter and cavity, both of which provide a theme and scene. The cavity portion is in a pre-selected shape of the theme, e.g., an ark shape, a barn shape, a whale shape. Our multi-layer puzzles resembles the standard single layer jigsaw puzzle in a square or rectangular shape and can be stacked for convenient storage. In an alternative embodiment, the present invention provides a puzzle book with a cover that tells a story relating to the theme and scenes. A multiple of multi-layered puzzles bound together with a cover by a hinge mechanism, i.e., back binding material, or other similar devices, comprises a story related to said theme. In another embodiment, at least one of the jigsaw pieces is cut to include the complete form, e.g., a figure that may be removed from the puzzle and played with as an individual, self-contained toy. In an alternative embodiment, the present invention comprises at least one blank, unpainted jigsaw piece cut to include the full subject, e.g., lamb, horse, for the purpose of painting or drawing upon by the user. In yet another embodiment the puzzle contains at least one complete blank, unpainted layer for the painting in of a scene by a user. Our multi-layer puzzle can be viewed essentially as a cross-sectional "journey" into an object or scene, whether it be a whale, a barn, or an ark. Other sourney's can be depicted. The user is taking a "walk" through the body of a whale or through an ark. The user is "stripping off" the layers to reveal what is beneath.

SUMMARY OF THE INVENTION

The present invention relates to a multi-layer jigsaw puzzle.

The multi-layer jigsaw puzzle comprises a base comprising a perimeter portion and a cavity portion disposed therein. The cavity portion is in a pre-selected shape of a theme. The base further comprises a first scene relating to the theme in the cavity portion and on the perimeter portion. The puzzle further comprises a first jigsaw layer comprising jigsaw pieces disposable within the cavity portion. This first layer comprises a second scene related to the theme. The puzzle further comprises at least one upper jigsaw layer comprising jigsaw pieces disposable above the first layer. These upper layer(s) comprise an additional scene(s) related to the theme.

In one embodiment, all of the layers are disposable within the cavity portion. Preferably, the upper jigsaw layer(s) are disposable above the first layer in the cavity in the same configuration as the first layer and when all of the layers are assembled, the final, e.g., uppermost, layer is flush with the perimeter portion of the base. In an alternative embodiment, the position of any layer within said cavity may be exchanged with that of other layers. Alternatively, the layers may be disposed below or above the base surface when assembled, so that they are not flush with the base surface. When all layers are returned to the cavity, any layer placed as the final or uppermost layer, will be flush with the base surface.

In another embodiment, at least one of the jigsaw pieces is cut to include the complete form, e.g., a figure, that may be removed from the puzzle and played with as an individual, self-contained toy. The piece is painted on both sides to fully represent the figure, e.g., lamb, horse, person, etc.

In yet another embodiment, the puzzle comprises at least one blank, unpainted jigsaw piece cut to include the full subject, e.g., lamb, horse, for the purpose of painting or drawing upon by the user.

In yet another embodiment, the puzzle contains at least one complete blank, unpainted layer for the painting in of a scene by a user.

In another embodiment, the puzzle further comprises a series of puzzle bases, each with its respective layers, hinged as the pages of a book, with a front cover. Each set of layers is set in its own individual base; the rear of each said base containing text relating a portion of the story reflected in the scene depicted on the adjacent, opposing layer. Thus, a multi-page book, is created; the one base being the final, or back cover. One or more puzzle pieces are cut to include the full subject, e.g., lamb, horse, which comprises a single play element, i.e., individual toy which are painted on both sides. This play element may be removed from the puzzle so that the user may act out the story in the book.

An example of the book would be "Birth of Bessie's Baby"; which is a journey through a mother cow's pregnancy, where the first multi-layer puzzle in the book depicts Bessie the mother cow in the first stage of pregnancy. The next multi-layer puzzle series would show the development of the baby calf inside Bessie in the second stage of her pregnancy. The third multi-layer puzzle series would show the development of the baby calf in the final stage of pregnancy; until the final multi-layer puzzle in the book, which depicts the calf just after birth learning to stand on its own. The story begins on the inside of the cover which holds the text beginning the story, explaining the scenes held on the puzzle layers on the opposing puzzle page; and continuing the text of the story on the back of each consecutive mult-layer puzzle, e.g., page, with the story ending on the back of the last interior puzzle page.

It is an object and advantage of the present invention to provide a multi-layer jigsaw puzzle that expresses a theme with scenes, having at least one piece cut in the form of a full subject which comprises a single play element, i.e., individual toy.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

DESCRIPTION OF THE DRAWINGS

FIG. 4 illustrates Noah's Ark 10 of FIG. 1 with layer 12" in base 14 with layer 12' below.

FIG. 5 illustrates Noah's Ark 10 of FIG. 1 showing cavity 16 in base 14 with layer 12" below.

FIG. 8 illustrates Red Barn 18 with layer 20' in base 22 with layer 20 below.

FIG. 9 illustrates Red Barn 18 with layer 20" in base 22 with layer 20' below.

FIG. 10 illustrates Red Barn 18 with cavity 24 in base 22 with layer 20" below.

FIG. 11 also illustrates jigsaw piece 38, cut to include the full subject, again in the shape of a horse which is painted on both sides to fully represent the subject for a play element, e.g., removable toy. This represents the single play element that may be removed from the cavity and played with as an individual toy.

FIG. 12 illustrates a jigsaw puzzle 10 of the present invention in the three different layers may be exchanged in different configurations, whereby 12 may be placed in cavity 16 in the original location of 12'. FIG. 12 also illustrates other possible configurations.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, application, patents, and publications cited above are hereby incorporated by reference.

DESCRIPTION OF THE PREFERRED EMBODIMENTS (BEST MODES FOR CARRYING OUT THE INVENTION)

The present invention relates to multi-layer puzzles. The multi-layer puzzle of the invention comprises at least two puzzle layers atop a base.

Figure 1:
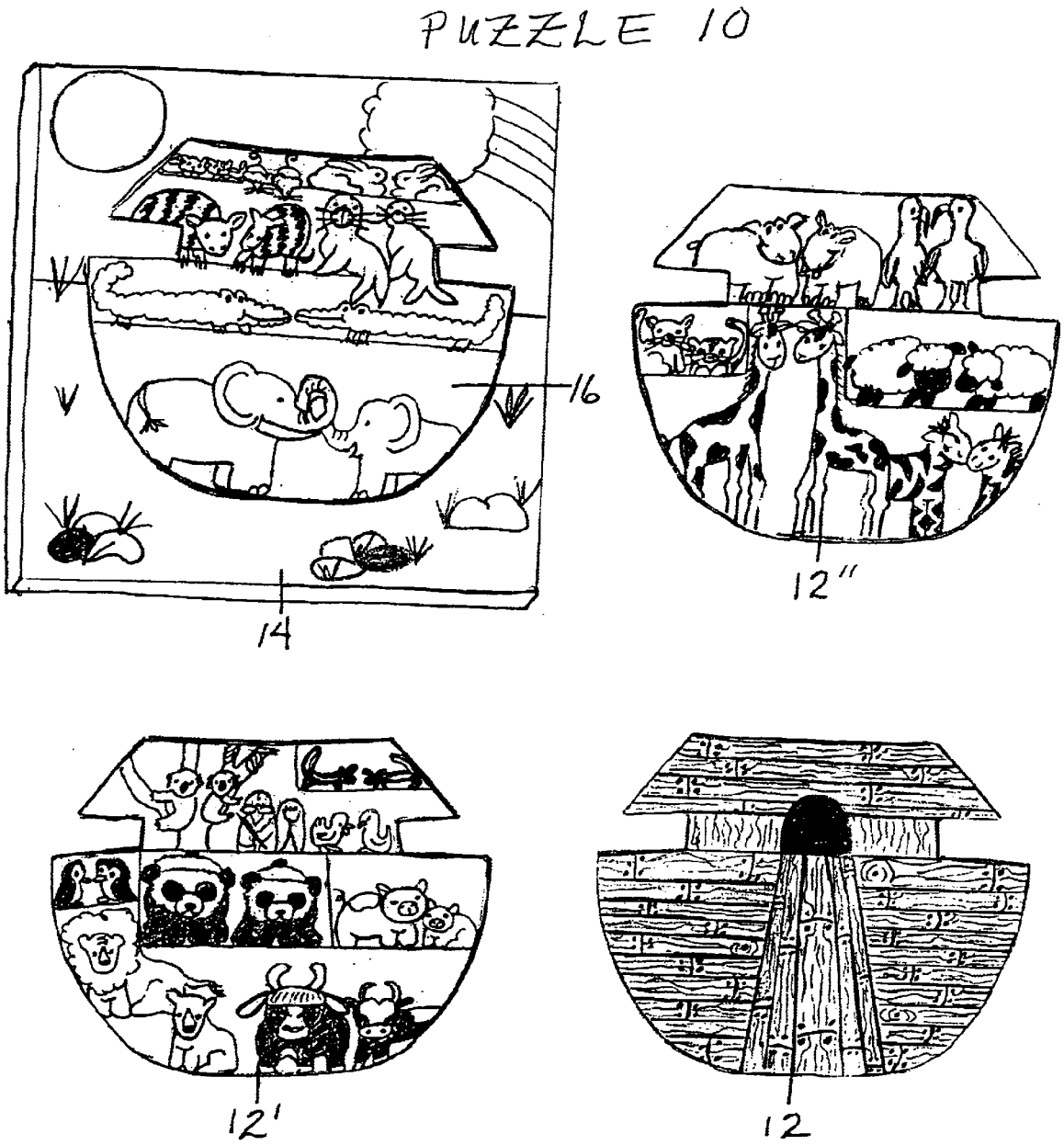
FIG. 1 illustrates a jigsaw puzzle of the invention with a Noah's Ark 10; with base 14 and cavity 16 with layers 12", 12' and 12.
Figure 2:
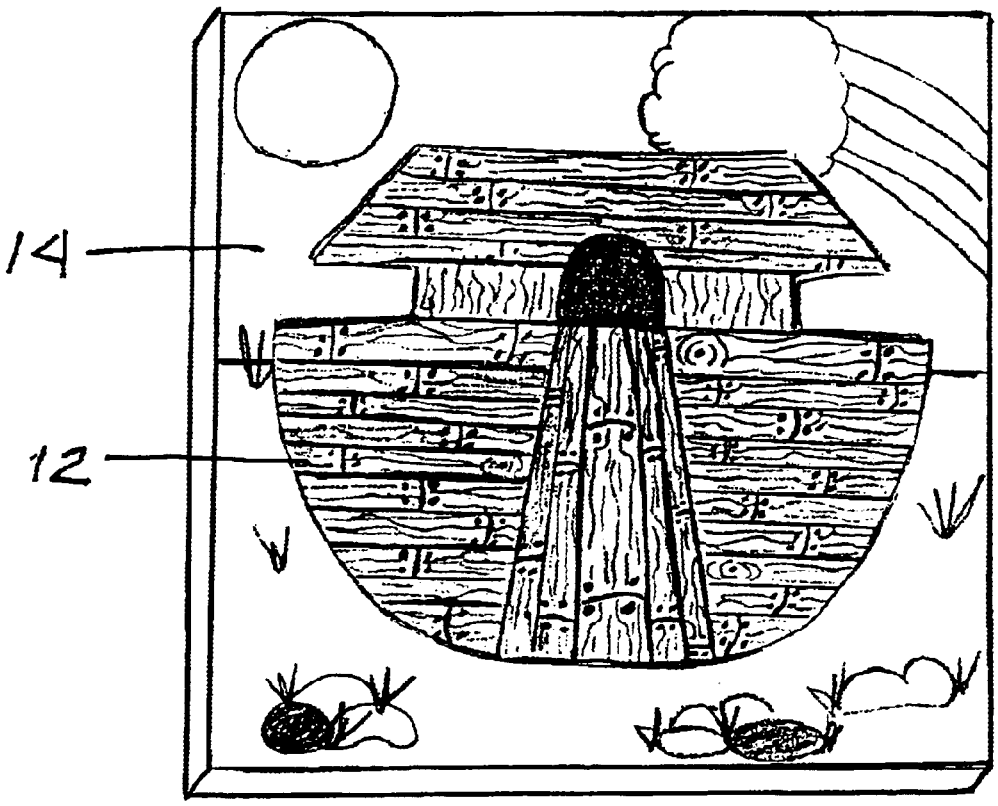
FIG. 2 illustrates Noah's Ark 10 of FIG. 1 with all the layers in the cavity with 12 flush with base 14.
Figure 3:
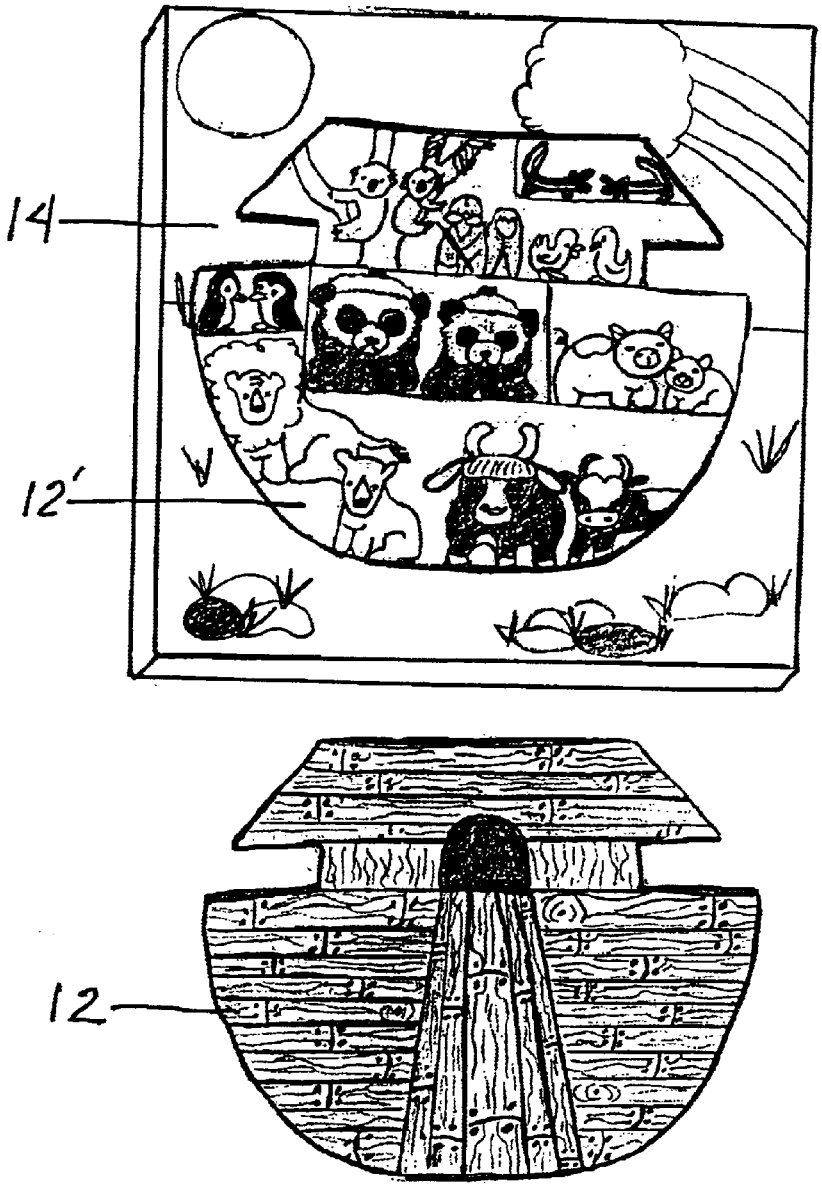
FIG. 3 illustrates Noah's Ark 10 of FIG. 1 with layer 12' in base 14 and layer 12 below.

The base and each layer preferably coordinate so that a central theme is depicted. For Example, a puzzle 10, such as shown in FIGS. 1–5, is in the configuration of Noah's Ark, FIGS. 1–5 show a three-layer puzzle 10 including a base 14. All the layers 12, 12', 12" and base 14 are shown in FIG. 1. FIG. 2 illustrates the top puzzle layer 12 depicting the ask exterior including the planks of the sides, gangplank, door and wheel house. The ark is shown resting on the ground. The top puzzle layer 12 is assembled and resting on base 14. Base 14 shows the ground with a blue sky, rainbow and sun in the background. FIG. 3 illustrates top layer 12, and the first interior layer (second puzzle layer) 12', depicting Noah, his wife, and pairs of animals. FIG. 4 also illustrates second interior layer (third puzzle layer) 12", depicting more pairs of animals. FIG. 4 also illustrates second interior layer 12" separated from the other layers 12 and 12'. FIG. 5 illustrates second interior layer 12"and base 14. Base 14 preferably further includes a cavity or depression 16 as the bottom scene; in this particular puzzle 10, the interior wall of the ark and more pairs of animals are shown. Cavity 16 is preferably deep enough to contain all layers 12, 12', and 12", so that when they are all assembled (layer 12" atop cavity 16; layer 12' atop layer 12'" and layer 12 atop layer 12'), they are flush with base surface 14. Base 14 provides support and rigidity for the various puzzle layers 12, 12' and 12". Alternatively, the layers may be disposed below or above the base surface, when assembled so that they are not flush with the base surface.

Figure 6:
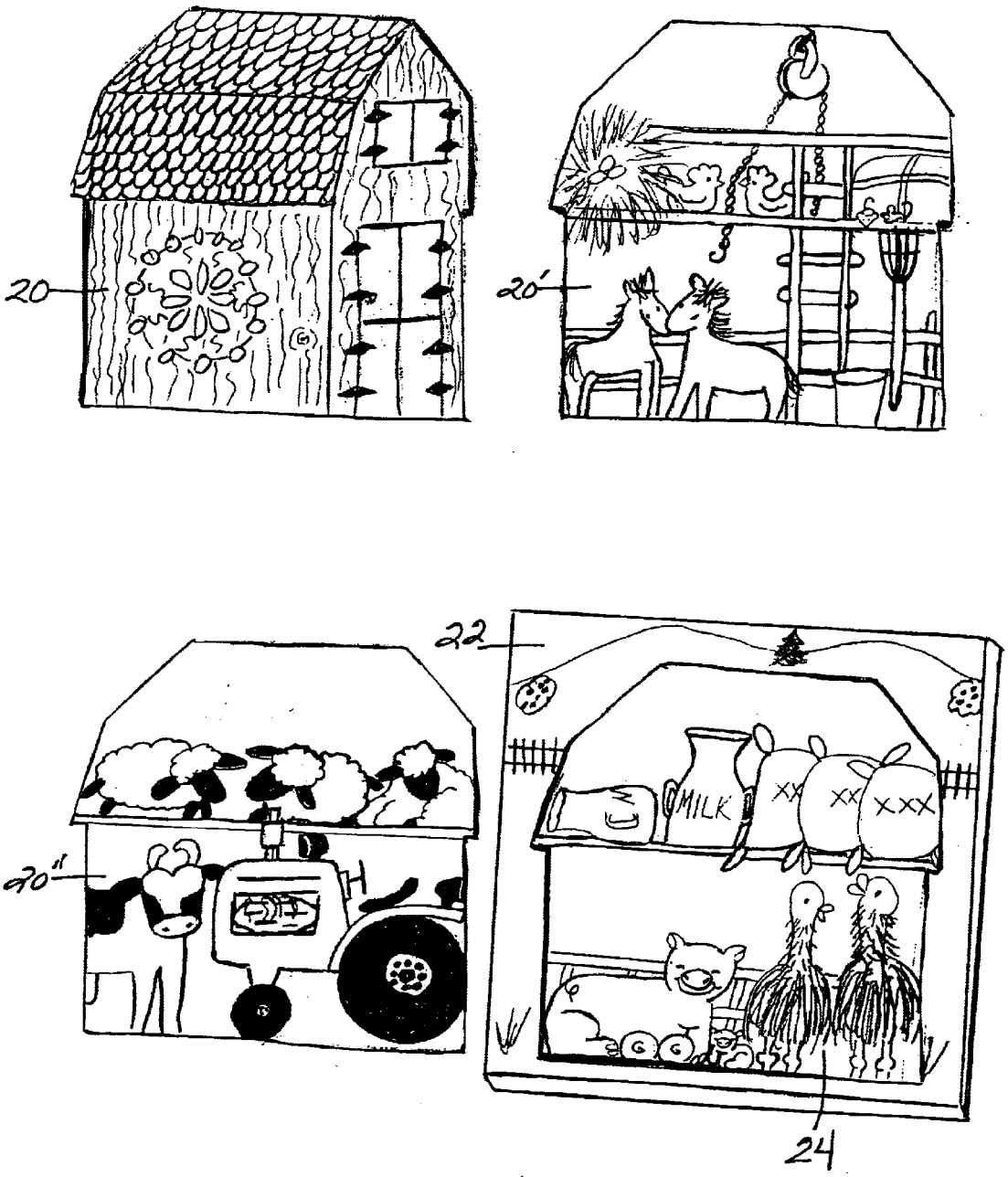
FIG. 6 illustrates a jigsaw puzzle of the invention Red Barn; with base 22 and cavity 24 with layers 20", 20', and 20.
Figure 7:
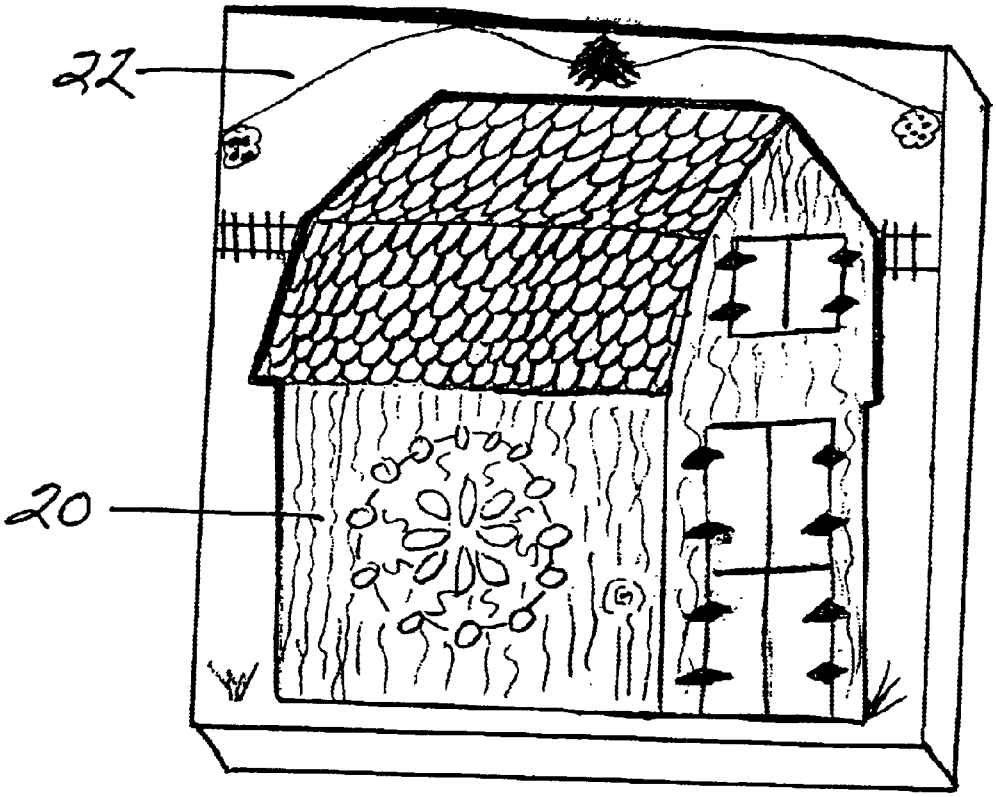
FIG. 7 illustrates Red Barn 18 with all the layer in the cavity with 20 flush with base 22.

FIGS. 6–10 show another puzzle 18 depicting a barnyard scene. FIG. 6 shows all three layers 20, 20' and 20" that can be assembled and disposed upon each other and atop base 22. Base 22 has a cavity 24 for containing the layers.

Other puzzles may follow this same theme, showing the exterior of a chosen object on the top, or outer layer, with interior details on succeeding or lower layers.

Other possible scenes include the following:

Jonah and the whale: Jonah is shown inside holding a sign on which is scrawled "help." Around Jonah are a few pieces of his boat, a broken chair and miscellaneous items. The base layer is painted to show an internal view of the whale's ribs.

A mountainside with a cave entrance: Succeeding layers show the narrow entranceway rocks that have fallen from the walls and ceiling, pieces of animal bone, a shovel and pick-axe, etc. The base painting is of a large interior space with some pottery, a fire pit and petroglyphs on the rear wall.

A car, pickup, semi-truck or bus: The first view is that of the exterior of the vehicle. Following layers proceed across the vehicle's interior to the opposite door.

A parking garage: Beginning with an outside picture of the building, the pictures move through many different parking places holding a variety of vehicles to the rear wall.

A spooky house in a dark forest: The first scene is that of the house and the surrounding forest. Entering the house, there are pictures of the main entryway, with a staircase, table, mirrors, umbrella stand, etc. Proceeding up the stairway, views of the interior rooms of the house are presented, along with the scary inhabitants (e.g., ghosts, goblins, vampires, etc.).

Buildings (houses, skyscrapers, laundro-mats, gasoline stations, office buildings, etc.): The views move from the exterior through the building to the far wall, showing all the contents of the building.

Fractions: Beginning with the whole numbers on the top layer, one moves to various fractions of the whole numbers using various shapes, sizes and color schemes for each unit.

Compound words: Beginning with the whole word on the top layer, removal of the first layer removes the prefix, then removal of the second layer removes the suffix, with the root word as the base of the puzzle. One puzzle set can contain several different root words with interchangeable prefixes and suffixes. For example, one puzzle could contain layers for the prefixes "re," "pre," and "pro" and layers for the suffixes "ing," "er," and "ed" along with several bases with root words such as "enter," "work," "claim," and "fix." This example puzzle set could produce the words "worker," "working," "rework," "entering," "reentering," "claimed," "reclaiming," "prefix," "fixed," and etc. Optionally, each layer may contain the definition of the word at each stage of the puzzle, with the definition changing in accordance with removal or addition of the various prefixes and suffixes.

Under the sea: From the surface of the sea with its seaweed and otter, the scenes move to fish and other sea creatures in the shallow depths (e.g., fish, whales, sharks, man-o-wars, etc.) to lower depths, and ending up on the sandy bottom with its bottom dwellers.

The human body: Beginning with the naked human body (either male or female), removal of the first layer of the puzzle would expose the muscles of the body, then the removal of second layer would expose the organs, and so on with the base of the puzzle depicting the human skeleton. Optionally, each puzzle layer would contain the names of each organ, muscle set, bone, etc., as it applies to the layer. The female puzzle could also contain one layer which depicts a baby growing in the uterus.

As can be appreciated by those skilled in the art, the puzzle of the invention contains at least two layers of puzzles atop a base. The puzzle may contain numerous layers, depending on the number of scenes wanting to be depicted. Further, the number of layers may be chosen based on the skill level of the child or adult who will be assembling the puzzle. The multi-layer puzzle of the present invention provides a greater challenge to the user than a single layer puzzle.

The size of the pieces and the cut of the pieces are also variable, depending on the skill level of the user. For example, larger pieces may be used with small children, medium pieces for older children and smaller pieces for adults. Likewise, a typical jigsaw cut may be utilized; or alternatively, straight cuts, animal shapes (e.g., outlining the animal in the puzzle), etc. may be used, depending on the desired effect and skill level.

The base and layers may be made of numerous materials, such as wood, plastic, ceramic, board, particle board, compressed board, cardboard, heavy paper, and the like. The puzzle may be fabricated from thick wood (e.g., ¼"–1"), rather than particleboard. This concept allows the pieces to fill an alternate function; doubling as playthings or display items (e.g., the animals or figures in the scenes depicted in the drawings) when the puzzle is not in use. In the Noah's ark puzzle (see FIGS. 1–5), the animals and Noah and his wife are play pieces. The designs may be painted on, laminated, glued, etc. to the layer surface prior to using a die cut or other cutting means, known in the art.

Figure 11:
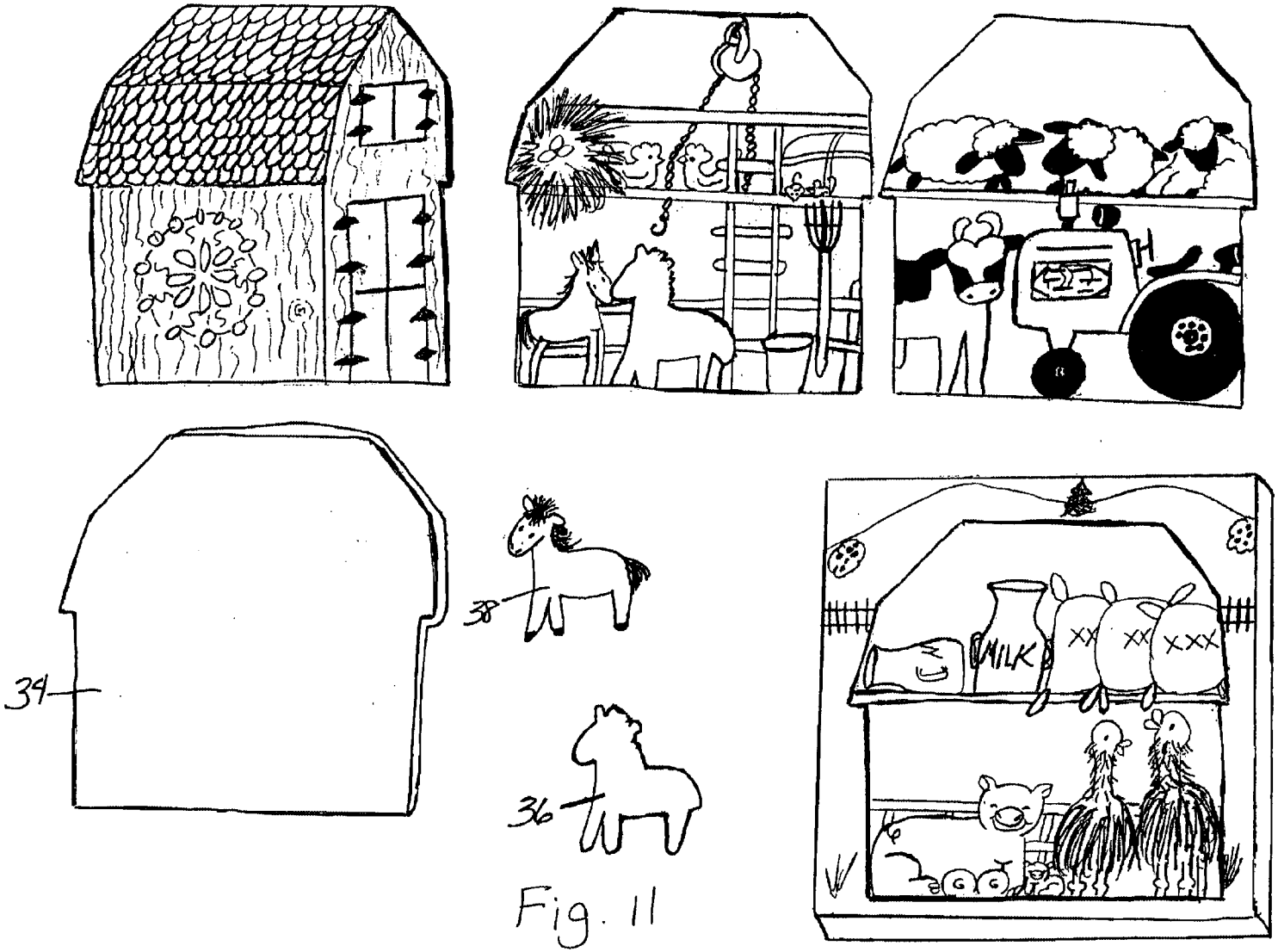
FIG. 11 illustrates a jigsaw puzzle of the FIG. 6 embodiment, with a complete, unpainted blank layer 34 for the painting of a scene by a user. Also illustrated is an unpainted, blank jigsaw piece 36 cut in the complete form of a horse for painting upon by a user.

In an alternative embodiment (see FIG. 11), at least one layer or pieces of the puzzle contain blanks 34, 36 that can be painted on or drawn on by the user or others. This gives one the possibility to be creative and make his/her own designs. In this embodiment, the layers are preferably primed for paint or markers.

In yet another embodiment (see FIG. 12), the three different layers may be placed in the cavity 16 in different configurations, whereby layer 12 may be placed in the cavity as layer 12' or 12", layer 12' as layer 12 or 12" and so forth.

Stand up puzzles may be manufactured in accordance with the present invention. Such articles are designed for overall home or office decoration with the multi-layer puzzles inside. The exterior can define the theme, and the interior puzzles expand on that theme. For example, the theme could concern a journey into a stand of cane on the edge of a field, with the first interior puzzle depicting a covey of quail at at the edge of the field near the stand of cane. The second interior puzzle would continue the journey depicting the quail feeding, further into the cane. The third layer focuses our attention deeper into the cane, depicting a mother quail in a nest with her eggs.

The stand up capability of the puzzle is accomplished by increasing the thickness of the base and the puzzle, e.g., layers and/or the number of puzzles, e.g., layers in the puzzle cavity. In this embodiment, there would be no need for a supporting leg or stand; the puzzle would stand on its own.

Figure 13:
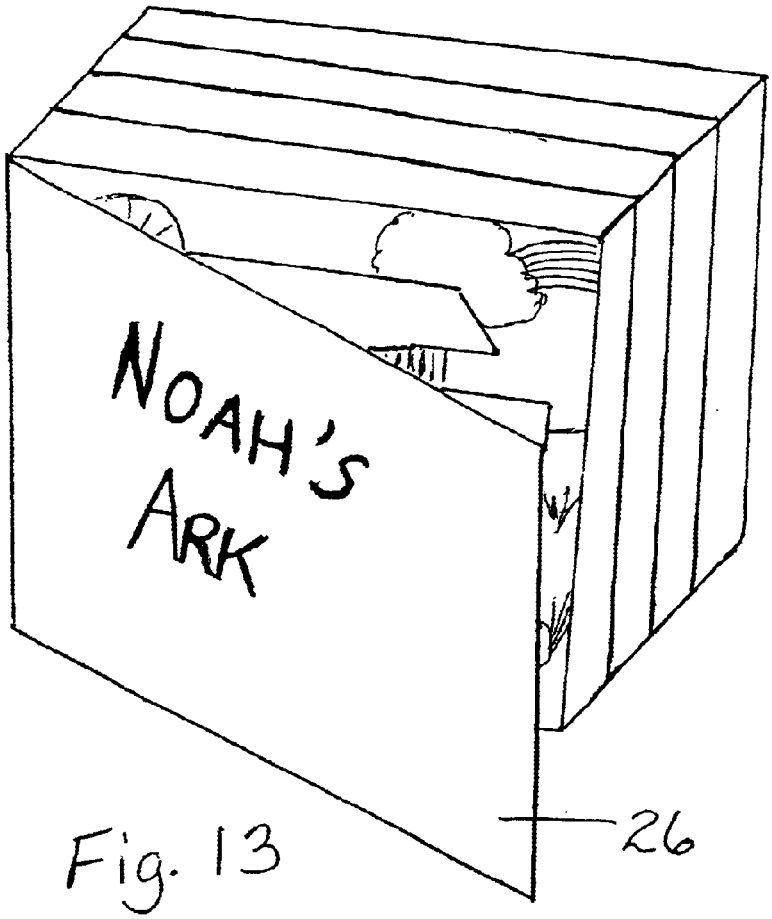
FIG. 13 illustrates a jigsaw puzzle of FIG. 2 embodiment showing a cover for a Noah's Ark book.
Figure 14:
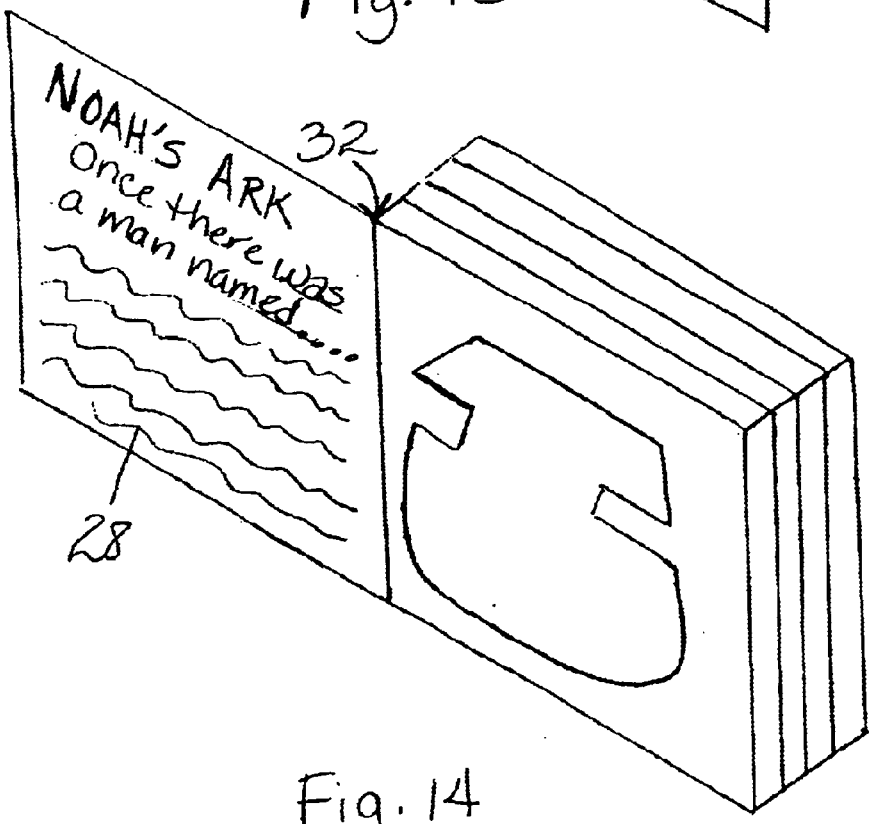
FIGS. 14–15 illustrate other views of Noah's Ark "book".
Figure 15:
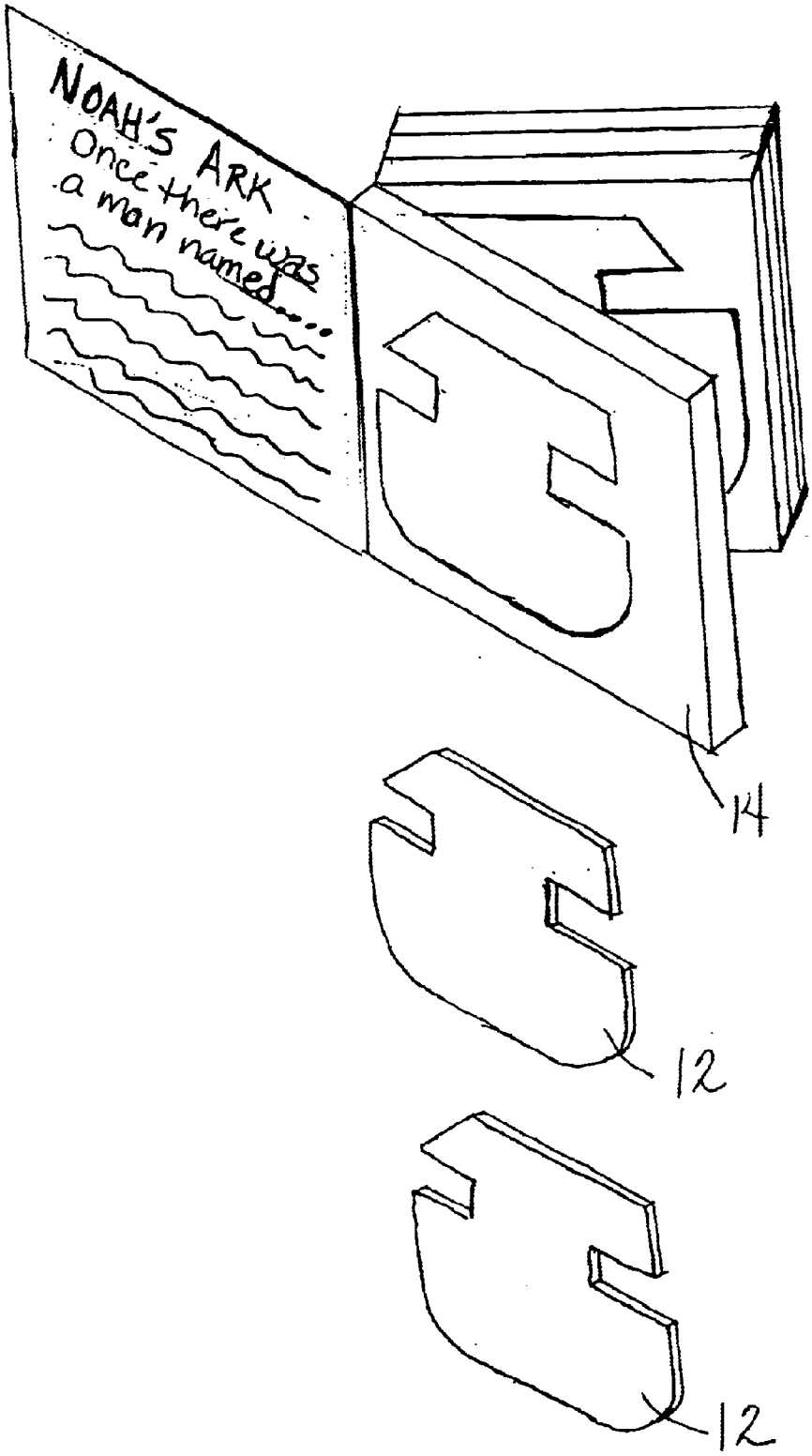

In still another embodiment (see FIG. 13), the invention comprises a puzzle book with a hard or soft exterior cover 26. The inside 28 (see FIG. 14) of the front cover (e.g., page 1) contains the beginning text of the story. A puzzle 10 corresponding to the text is on the facing page (e.g., page 2). Cover 26 is opened at hinge 32 to reveal puzzle 10 (see FIG. 15), made up of base 14, cavity 16, and layers 12, 12', and 12". This story is continued with the text on the left, e.g., the back of the previous puzzle, and the puzzle on the right, continuing to the back of the book. The number of puzzles and the number of layers in each book varies according to cost and complexity of the story line. Some story concepts for puzzle books are as follows:

Noah's Ark and any other stories, such as discussed above;

Dinosaurs with each puzzle page from a different era;

Stages of life such as planting a seed and seeing the growth development;

Four seasons of the desert, mountains, plains, rainforest, etc.;

Eggs and chickens;

Here comes baby (stages of life); from conception to birth with notes about what is happening in each stage, Note that this theme can be used with animals such as puppies, kittens and insects,as well as humans.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A multi-layer jigsaw puzzle comprising:

a base comprising a perimeter portion and a cavity portion disposed therein, said cavity portion in a pre-selected shape of a theme, said base further comprising a first scene representing the furthermost boundary of the theme, such as the interior of an outside wall, the inner most area of a human or animal body, or the far side of cane brake, said theme relating to said theme in said cavity portion and on said perimeter portion;

at least one intermediate jigsaw layer the same shape as said cavity comprising irregularly-shaped jigsaw pieces disposable within said cavity portion, said intermediate layer comprising a second entertaining and educational scene related to said theme; representing the interior of the subject theme; and an upper jigsaw layer comprising irregularly shaped jigsaw pieces disposable above said intermediate layer, said upper layer comprising an additional scene related to said theme wherein, one or more jigsaw pieces of a least one intermediate or upper layer may be cut in the full form of an entity within said scene i.e., horse lamb, human, etc., to be used as an individual play element, e.g., a toy that may be removed from the puzzle and played with.

2. The puzzle of claim 1 wherein all said layers are disposable within said cavity portion, whereby positions of the layers within said cavity may be alternated to present a variation on the theme, i.e.,.

3. The puzzle of claim 2 wherein when all of said layers are assembled they are flush with said perimeter portion.

4. The puzzle of claim 1 wherein at least one of the said jigsaw pieces is cut to include the full subject, e.g., lamb, horse, to comprise a single play element and, the piece is painted on both sides to fully represent the subject; wherein this single play element may be removed from the cavity and played with as an individual, self-contained toy.

5. The puzzle of claim 1 wherein said upper jigsaw layer is disposable above said first layer in the same configuration as said first layer and, its position within said cavity may be exchanged with that of other layers, where the layer may be disposed below or above the base surface when assembled, so that it may not lie flush with the base surface; noting that if all layers are returned to the cavity, the final or topmost layer will be flush with the base surface.

6. The puzzle of claim 1 wherein at least one layer includes at least one blank, unpainted jigsaw piece cut in complete form, e.g., lamb, horse, for painting or drawing upon by a user.

7. The puzzle of claim 1 wherein at least one said layer comprises a complete, unpainted blank layer for the painting in of a scene by a user.

8. The puzzle of claim 1 wherein said layers can be placed in the base cavity in alternative positioning, e.g., layer 1 is placed as layer 3 and layer 2 as layer 1, and so on, noting that if all layers are returned to the cavity, the final or top-most layer will be flush with the base surface.

9. Multiples of the puzzle of claim 1 are bonded together by a hinge mechanism, i.e., book binding material, multiple mechanical hinges or other similar devices, and a cover added which is also hinged by one of the aforementioned methods to form a book with a cover added, wherein the outside of the cover would hold the title of the story, with the text of the story beginning on the inside, e.g., back, of the cover and, continuing on the back of each succeeding multi-layer puzzle, e.g., page, with the story ending on the back of the last interior puzzle page.

10. The puzzle of claim 9, e.g., a multi-layer puzzle joined with other multi-layer puzzles of claim 1 to form a book with a cover where, one or more puzzle pieces are cut to include the full subject, e.g., lamb, horse, to comprise a single play element, i.e., individual toy, enabling the user to remove said play element from the puzzle so that the user may act out the story in the book.

* * * * *